US009885539B2

(12) United States Patent
Spransy et al.

(10) Patent No.: US 9,885,539 B2
(45) Date of Patent: Feb. 6, 2018

(54) BALLISTIC RESPONDER SHIELD

(71) Applicants: Peter J. Spransy, Salt Lake City, UT (US); Mitch Soper, Riverton, UT (US)

(72) Inventors: Peter J. Spransy, Salt Lake City, UT (US); Mitch Soper, Riverton, UT (US)

(73) Assignee: DAW TECHNOLOGIES, LLC, Salt Lake City, UT (US)

( * ) Notice: Subject to any disclaimer, the term of this patent is extended or adjusted under 35 U.S.C. 154(b) by 0 days.

(21) Appl. No.: 15/374,733

(22) Filed: Dec. 9, 2016

(65) Prior Publication Data

US 2017/0167826 A1 Jun. 15, 2017

Related U.S. Application Data

(60) Provisional application No. 62/264,964, filed on Dec. 9, 2015.

(51) Int. Cl.

| | |
|---|---|
| ***F41H 5/12*** | (2006.01) |
| ***F41C 27/04*** | (2006.01) |
| ***F41A 23/02*** | (2006.01) |
| ***F41H 5/08*** | (2006.01) |

(52) U.S. Cl.

CPC ..... *F41C 27/04* (2013.01); *F41A 23/02* (2013.01); *F41H 5/08* (2013.01)

(58) Field of Classification Search

CPC .. F41C 27/00; F41C 27/04; F41H 1/00; F41H 5/08; F41H 5/10; F41H 5/12

USPC ..... 89/36.06

See application file for complete search history.

(56) References Cited

U.S. PATENT DOCUMENTS

| | | | | |
|---|---|---|---|---|
| 2,215,204 | A * | 9/1940 | Young | F41A 9/54 89/33.01 |
| 5,392,686 | A * | 2/1995 | Sankar | F41H 5/08 109/49.5 |
| 6,270,231 | B1 * | 8/2001 | Kerr | F21L 15/14 362/110 |
| 6,807,890 | B1 | 10/2004 | Fuqua | |
| 6,907,811 | B2 | 6/2005 | White | |
| 7,117,544 | B2 | 10/2006 | Dehart | |
| 7,302,880 | B1 * | 12/2007 | Elasic | F41H 5/08 89/36.01 |
| 7,520,206 | B2 * | 4/2009 | Baker | F41H 5/08 89/36.05 |
| 7,520,207 | B1 | 4/2009 | Fuqua et al. | |
| 7,784,390 | B1 * | 8/2010 | Lowell | F41C 7/00 42/1.08 |

(Continued)

FOREIGN PATENT DOCUMENTS

| | | | | |
|---|---|---|---|---|
| JP | 2004294046 A * | 10/2004 | | F41C 27/04 |

*Primary Examiner* — Derrick R Morgan
(74) *Attorney, Agent, or Firm* — Madison IP, P.C.

(57) ABSTRACT

A ballistic shield is detachably attachable to a weapon. The shield may be manipulated into a deployed configuration, a gun rest configuration, and a storage configuration. The shield has a shield body with a rigid upper portion, a flexible lower portion, and a quick release connector. That shield may also have a visor attachable to the shield that extends above the rigid upper portion of the shield. The quick release is secured to the shield body for removable connection of the weapon. The flexible lower portion drapes from the rigid upper portion when in the deployed configuration where the weapon is connected to the shield and the responder aims the weapon in a shooting position.

19 Claims, 6 Drawing Sheets

(56) References Cited

U.S. PATENT DOCUMENTS

| | | | | |
|---|---|---|---|---|
| 7,849,781 | B2 | 12/2010 | White | |
| 7,891,283 | B2 | 2/2011 | Kleniatis et al. | |
| 8,015,910 | B1 | 9/2011 | Fuqua et al. | |
| 8,276,498 | B1 * | 10/2012 | Hannibal | F41H 5/08 89/36.05 |
| 8,276,499 | B1 | 10/2012 | Fuqua et al. | |
| 8,511,215 | B1 * | 8/2013 | Tervola | F41H 5/08 89/36.03 |
| 8,549,979 | B2 | 10/2013 | Spransy | |
| 9,345,240 | B1 * | 5/2016 | Cain, Jr. | A01M 31/06 |
| 2005/0217472 | A1 * | 10/2005 | Baker | F41H 5/08 89/36.06 |
| 2007/0193441 | A1 * | 8/2007 | Carter | F41H 5/08 89/36.07 |
| 2011/0226123 | A1 * | 9/2011 | Priebe | F41H 5/08 89/36.02 |
| 2011/0239850 | A1 * | 10/2011 | Raiser | F41H 5/08 89/36.02 |
| 2013/0098234 | A1 * | 4/2013 | Armellino, Jr. | F41H 5/08 89/36.05 |
| 2013/0213209 | A1 * | 8/2013 | Mulcahey | F41H 1/00 89/36.02 |
| 2017/0038001 | A1 * | 2/2017 | Semple | F16M 13/04 |
| 2017/0038179 | A1 * | 2/2017 | Martin | F41H 5/013 |
| 2017/0199012 | A1 * | 7/2017 | Mulcahey | F41H 5/08 |

* cited by examiner

BALLISTIC RESPONDER SHIELD

RELATED APPLICATION

This patent application claims the benefit of U.S. Provisional Patent Application Ser. No. 62/264,964 that was filed on Dec. 9, 2015, for an invention titled BALLISTIC RESPONDER SHIELD, which is hereby incorporated herein by this reference.

BACKGROUND OF THE INVENTION

1. Field of the Invention

The present invention relates to systems and methods for protecting first responders. More specifically, the present invention relates to systems and methods that provide light-weight, foldable, weapon attachable shields for first responders.

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

2. The Relevant Technology

Law enforcement agencies, particularly SWAT teams, are often called upon to confront armed and dangerous individuals. It is not uncommon for these agencies to be facing 44 magnum or 9 mm handgun rounds, and even shotgun blasts. Additionally, in an "active shooter" situation where lives are being lost, responding law enforcement has very little time to prepare or assess the situation. Historically, active shooter situations are over in less than 5 minutes.

Although it is standard practice for law enforcement to wear body armor and police identification, typically when officers are called upon to stop an active shooter they will not take the time to put on body armor, police identification, or even grab a handheld shield because it slows down the response time of the officer. Tragically, any delay in response usually results in more casualties. There is always a tradeoff between speed and protection. Without proper protection and/or identification, these officers are vulnerable to hostile fire, as well as friendly fire. Furthermore, it should be understood that, particularly in school shootings, officers are more concerned with the preservation of life than they are about their own safety.

For additional protection (to wearing personal body armor), personal shields may be employed. Shields provide an additional layer of protection; however, currently available shields are hand carried, so manipulating a weapon is severely limited because at least one of the officer's hands is occupied carrying the shield. Ballistic rated shields are heavy and therefore hinder the ability of the officer to travel long distances due to their weight (approximately 30+ pounds). At the end of a long run, holding a weapon and a shield is difficult. Aiming the weapon accurately is nearly impossible.

In the confusion of active shooter situations, where multiple agencies may be responding, including but not limited to, police, SWAT, plainclothes policemen and even gun carrying civilians, it is paramount that the police officers are easily identified. Identification of officers can help to avoid friendly fire mishaps.

It has been determined that in active shooter situations, if the responding police can draw the attention of the active shooter away from the victims toward themselves, this action saves lives. For this reason, it has also been considered important to identify officers so that the active shooter's attention might be diverted to the identifiable officer.

Accordingly, a need exists for a new system and method for protecting first responders that addresses one or more of these issues. Specifically, a new system and method is needed that is light-weight, rapidly deployable, identifies the user, and provides ballistic protection for first responders. Such systems and methods are disclosed herein.

BRIEF SUMMARY OF THE INVENTION

The present disclosure describes developments responsive to the present state of the art, and in particular, in response to the problems and needs in the art that have not yet been fully solved by currently available ballistic shielding.

Police responding to an active shooter must run to meet the threat. In these situations, time matters. An exemplary embodiment of the present first responder shield is composed of flexible ballistic material that does not interfere with the mobility of the officer by hitting his/her legs. The top third of the shield is rigid and can serve as a gun rest when the officer is in the prone position. The rigid portion of the first responder shield is sized to approximate the height of a bi-pod gun rest, although this dimension could be adjusted for other applications, or customized to the height of the officer.

Currently there are two rating systems for ballistic protection: 1) Underwriters' laboratory, (UL) and 2) The National Institute of Justice, (NIJ). The rating systems are not consistent between the two entities.

The level of protection required for each confrontation can vary widely. However, the vast majority of active shooter situations are perpetrated using handguns and/or shotguns because these weapons can be easily concealed and carried into schools, colleges, public areas, etc. The present first responder shield is N.I.J. Level IIIA, but could be developed for higher or lower threat levels.

The following description focuses primarily on the requirements of law enforcement agencies; however, it is evident and has been considered that this first responder shield could be used by various agencies such as, but not limited to: military, secret service, homeland security, etc.

The first responder shield depicted in the drawings is a police "identifier" because it has "POLICE" in large letters on the front of the shield. It should be understood, however, that any identifier indicia could be used, such as SWAT, DEA, FBI, etc. To make the first responder shield more attention grabbing for identification purposes, the exemplary first responder shield may have small LED red and blue flashing lights integrated onto the shield to actually draw attention to the shield.

The exemplary first responder shield is designed primarily to provide an integral light-weight rifle mountable shield that is already attached/attachable to the responding officer's weapon when called upon to respond to an active shooter. The unique design permits users to arrive at a conflict, grab their weapon and go to meet the threat while the weapon is at the ready, thus obtaining ballistic protection, police identification and fire power in one simple action.

An exemplary first responder shield may be constructed in several iterations of the responder shield; however, the basic shield is comprised of lightweight flexible ballistic material such as Dyneema. With some exemplary responder shields, the top third of the shield is rigid (an upper rigid portion) for the mounting bracket and to serve as a gun rest in certain shooting positions and the bottom two-thirds (a lower flexible portion) drapes downward when deployed and may be folded. The shield may fold into thirds for storage and may remain attached to the weapon (folded or unfolded) or the shield may be detached utilizing a quick disconnect/connect mechanism for detachment or attachment.

The body of the shield is sufficiently flexible that lower flexible portion is foldable against itself at least once so that the shield body folds into a relatively compact space having a foot print that is at least half of the area of the shield body and has a height profile lower than the height of the upper rigid portion when the shield assembly is in the storage configuration. If at least two folds are used, the foot print will be about a third of the area of the shield body and the height profile may be less than half of the height of the upper rigid portion. Of course, the foot print and profile are somewhat dependent on the size of the upper rigid portion compared to the lower flexible portion, the larger the upper rigid portion, the larger the foot print, and the longer the lower flexible portion, the higher the profile.

The size of the shield may vary depending upon individual preference and/or size of user. Presently, the exemplary responder shield is rated for N.I.J. Level IIIA, but it should be understood that as technologies evolve and materials become more light-weight and the ballistic rating for the shield could increase, a higher rating may be achieved.

The exemplary responder shield is suitable for right-handed or left-handed users and is balanced to not affect the ability of the user to aim the attached weapon. Integrating a ballistic transparent visor into the shield has been contemplated, particularly as technology reduces the weight of ballistic vision material. Integrating lights, particularly red and blue flashing lights also have been contemplated. The shield is light-weight, presently the exemplary shield weighs less than five pounds. Storage is facilitated by its ability to fold flat into thirds. These and other features of the exemplary responder shields of the present invention will become more fully apparent from the following description, or may be learned by the practice of the invention as set forth hereinafter.

BRIEF DESCRIPTION OF THE DRAWINGS

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list. Additionally, the terms "operator", "user", "officer", "soldier", and "individual" may be used interchangeably herein unless otherwise made clear from the context of the description.

Figure 1:
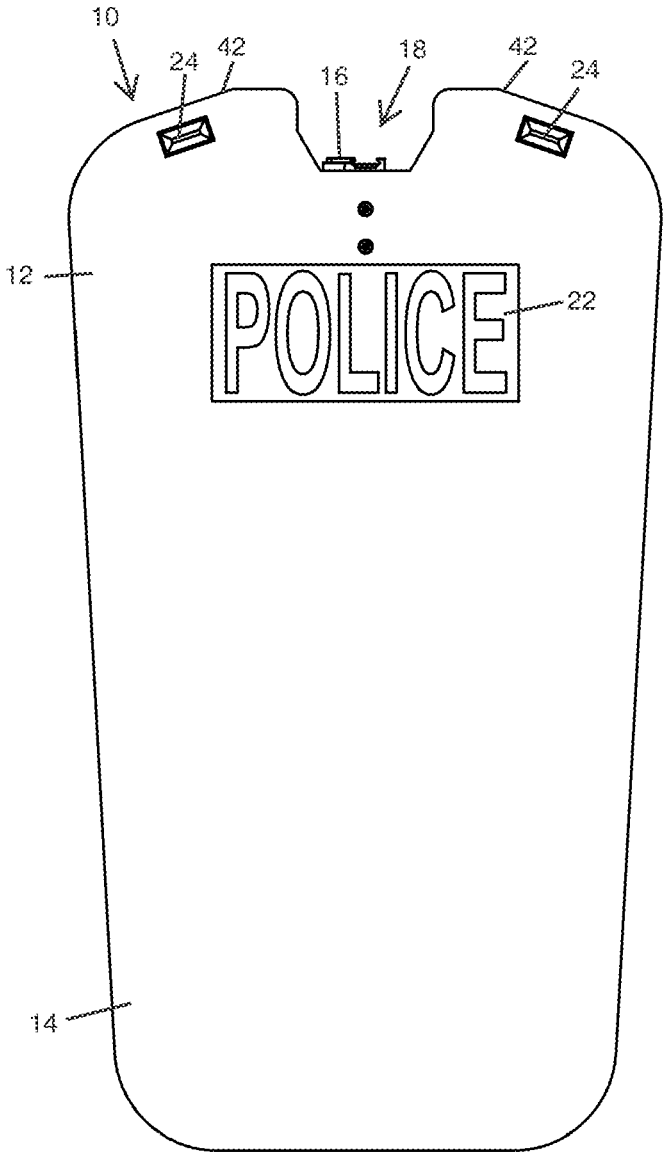
Figure 2:
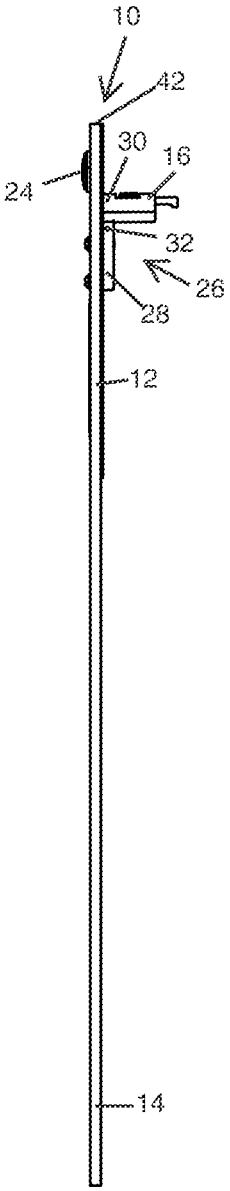
Figure 3:
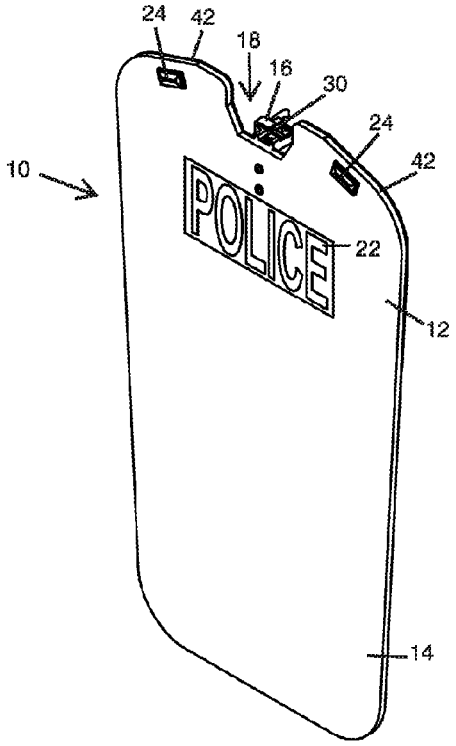
Figure 4:
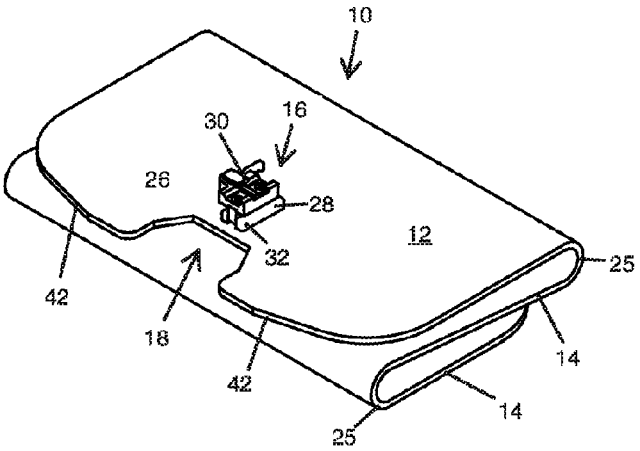
Figure 5:
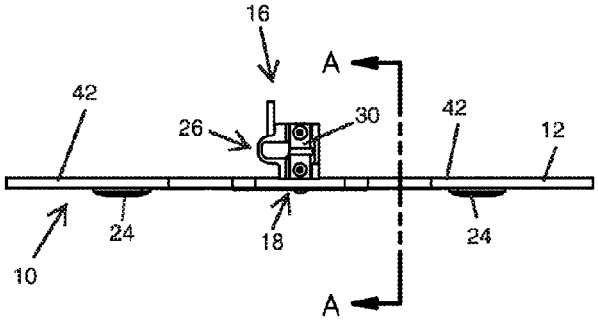
Figure 6:
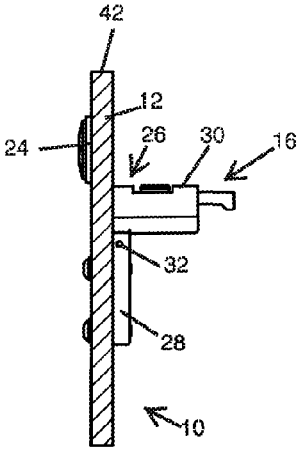
Figure 7:
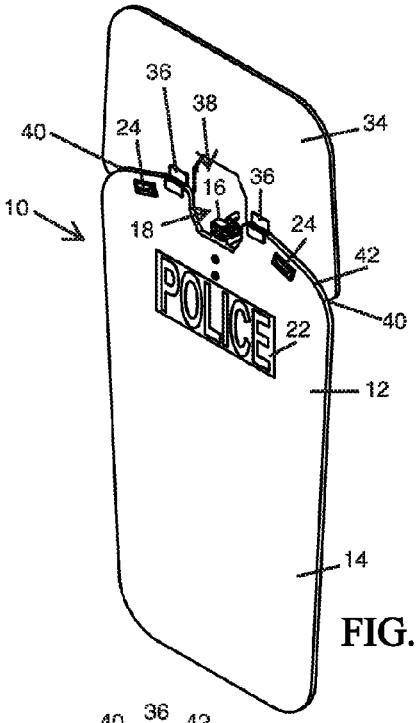
Figure 8:
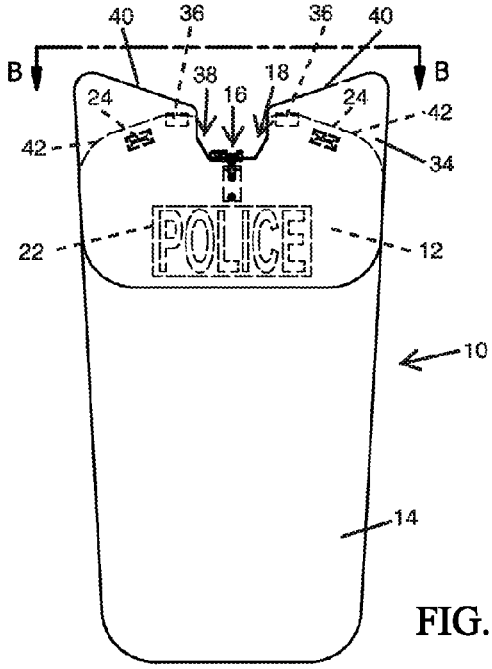
Figure 10:
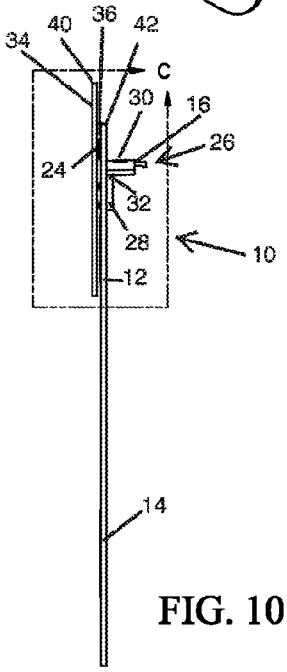
Figure 9:
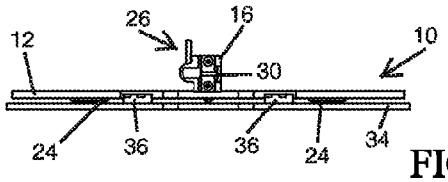
Figure 11:
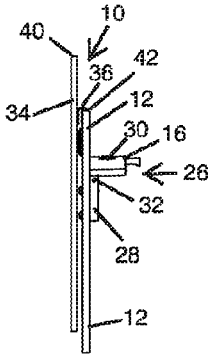
Figure 12:
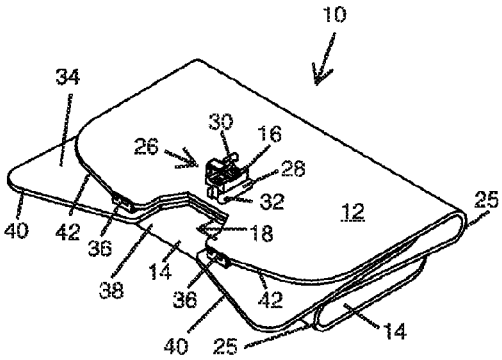
Figure 13:
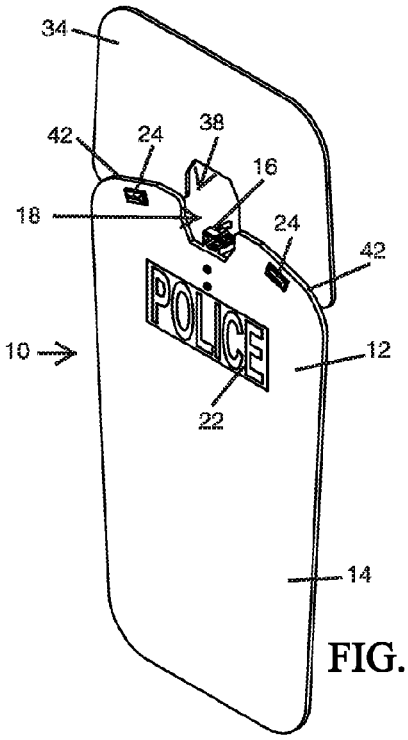
Figure 15:
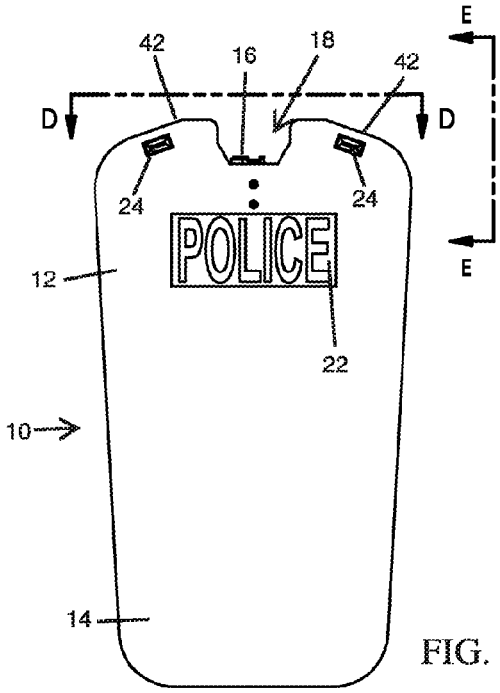
Figure 16:
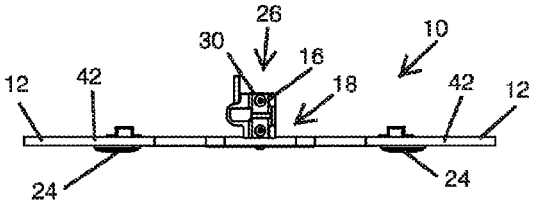
Figure 17:
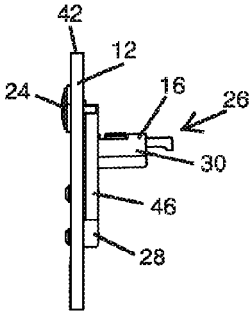
Figure 14:
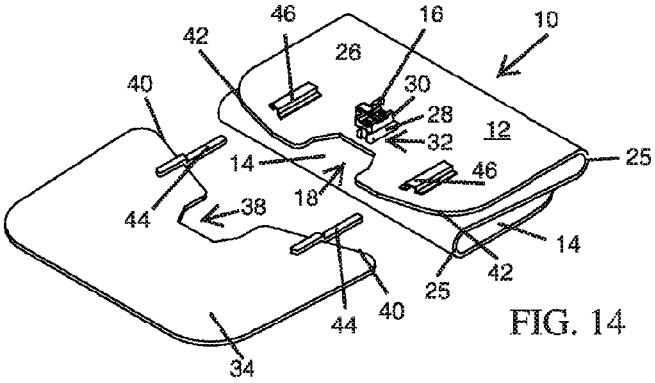
Figure 18:
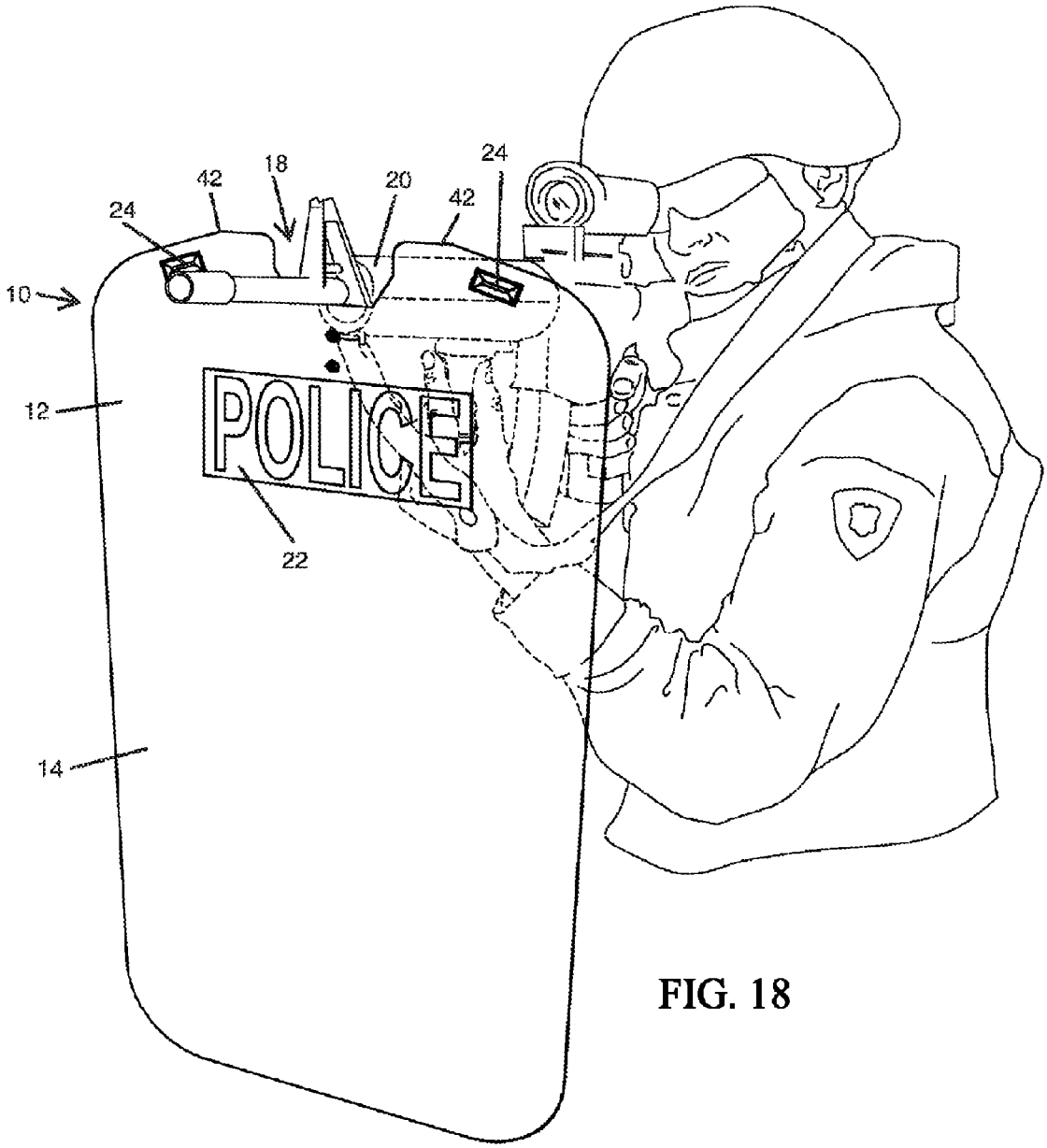
Figure 19:
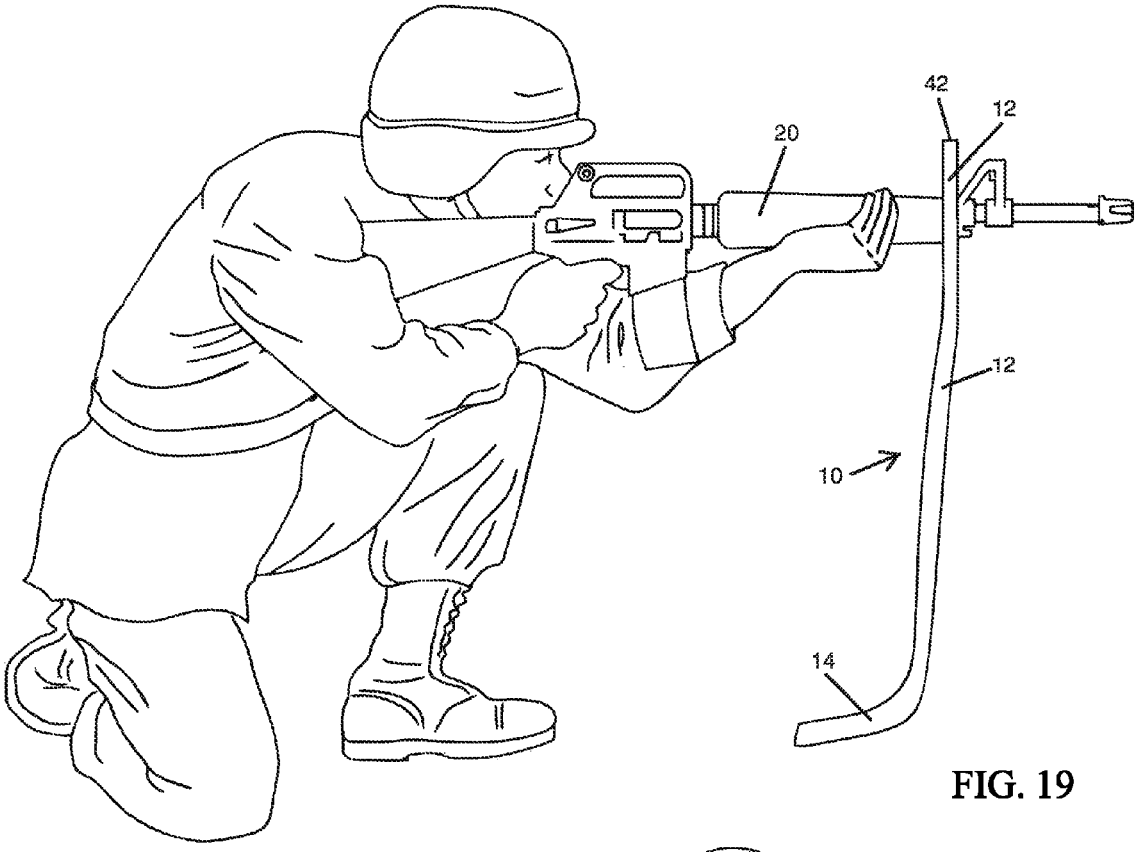
Figure 20:
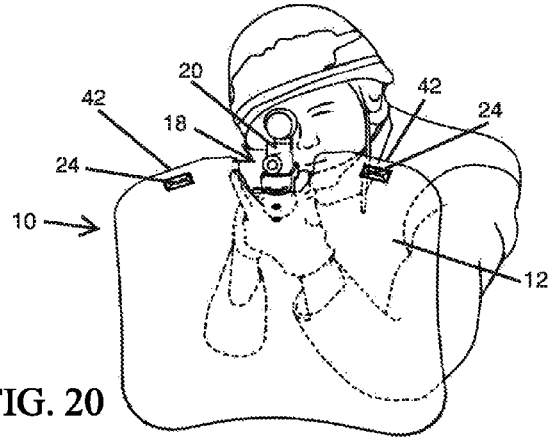

Understanding that these drawing(s) depict only typical exemplary embodiments of the invention and are not therefore to be considered to be limiting of its scope, the invention will be described and explained with additional specificity and detail through the use of the accompanying drawings in which:

FIG. 1 is an elevational front view of an exemplary responder shield draped downward as if deployed for use;

FIG. 2 is an elevational side view of the exemplary responder shield of FIG. 1;

FIG. 3 is a perspective view of the exemplary responder shield of FIG. 1;

FIG. 4 is a perspective view of the exemplary responder shield of FIG. 1 folded into a low-profile configuration;

FIG. 5 is a top view of the exemplary responder shield of FIG. 1;

FIG. 6 is an enlarged section view of the quick connector along line A-A of FIG. 5;

FIG. 7 is an elevational perspective view an alternative exemplary responder shield draped downward as if deployed for use and bearing a visor secured into position by a lockable hinge;

FIG. 8 is an elevational front view of the alternative exemplary responder shield of FIG. 7 with the visor folded downward;

FIG. 9 is a top view of the alternative exemplary responder shield along the line B-B of FIG. 8;

FIG. 10 is an elevational side view of the alternative exemplary responder shield of FIG. 8 showing the visor folded downward;

FIG. 11 is an enlarged elevational side view of the alternative exemplary responder shield of FIG. 8 showing the area C in detail;

FIG. 12 is a perspective view of the alternative exemplary responder shield of FIG. 8 folded into a low-profile configuration with the visor tucked between a fold of the shield;

FIG. 13 is an elevational perspective view another exemplary embodiment of a responder shield draped downward as if deployed for use and bearing a visor secured into position by insertable posts within receiving channels;

FIG. 14 is an exploded perspective view of the exemplary responder shield of FIG. 13 folded into a low-profile configuration with the visor detached, but positioned for the insertable posts to enter into the receiving channels;

FIG. 15 is an elevational front view of the alternative exemplary responder shield of FIG. 13 with the visor removed;

FIG. 16 is a top view of the alternative exemplary responder shield along the line D-D of FIG. 15;

FIG. 17 is an enlarged elevational side view of the alternative exemplary responder shield along line E-E of FIG. 15;

FIG. 18 is a perspective view of a user in a standing position for shooting with an exemplary responder shield secured to and draped from the user's weapon;

FIG. 19 is a perspective view of a user in a kneeling position shooting with an exemplary responder shield secured to and draped from the user's weapon, where the lower portion of the shield touches the ground;

FIG. 20 is a perspective view of a user in a prone position for shooting with an exemplary responder shield secured to and acting as a gun rest for the user's weapon.

REFERENCE NUMERALS

| | |
|---|---|
| shield 10 (also responder shield 10) | upper rigid portion 12 |
| lower flexible portion 14 | quick release connector 16 |
| weapon notch 18 | weapon 20 |
| indicia 22 | lights 24 |
| fold 25 | hinge assembly 26 |
| shield attachment portion 28 | weapon attachment portion 30 |
| hinge pin 32 | visor 34 |
| lockable hinges 36 | visor weapon notch 38 |
| lower edge 40 | upper edge 42 |
| insertable posts 44 | receiving channels 46 |

DETAILED DESCRIPTION OF THE INVENTION

The exemplary embodiments of the present disclosure will be best understood by reference to the drawings, wherein like parts are designated by like numerals throughout. It will be readily understood that the components of the exemplary embodiments of the present invention, as generally described and illustrated in the figures herein, could be arranged and designed in a wide variety of different configurations. Thus, the following more detailed description of the exemplary embodiments, as represented in the Figure(s), is not intended to limit the scope of the invention, as claimed, but is merely representative of exemplary embodiments of the disclosure.

The word "exemplary" is used exclusively herein to mean "serving as an example, instance, or illustration." Any embodiment described herein as "exemplary" is not necessarily to be construed as preferred or advantageous over other embodiments. While the various aspects of the embodiments are presented in drawings, the drawings are not necessarily drawn to scale unless specifically indicated.

In this application, the phrases "connected to", "coupled to", and "in communication with" refer to any form of interaction between two or more entities, including mechanical, capillary, electrical, magnetic, electromagnetic, pneumatic, hydraulic, fluidic, and thermal interactions.

The phrases "attached to", "secured to", and "mounted to" refer to a form of mechanical coupling that restricts relative translation or rotation between the attached, secured, or mounted objects, respectively. The phrase "slidably attached to" refer to a form of mechanical coupling that permits relative translation, respectively, while restricting other relative motions. The phrase "attached directly to" refers to a form of securement in which the secured items are in direct contact and retained in that state of securement.

The term "abutting" refers to items that are in direct physical contact with each other, although the items may not be attached together. The term "grip" refers to items that are in direct physical contact with one of the items firmly holding the other. The term "integrally formed" refers to a body that is manufactured as a single piece, without requiring the assembly of constituent elements. Multiple elements may be integrally formed with each other, when attached directly to each other from a single work piece. Thus, elements that are "coupled to" each other may be formed together as a single piece.

Turning to FIGS. 1-3, an exemplary shield 10 (sometimes also referred to as "first responder shield" or "responder shield") is depicted. FIG. 1 is an elevational front view of the exemplary shield 10 as deployed for use; however, a weapon has not been attached, so not to obscure the components of the shield 10. FIG. 2 is an elevational side view of the exemplary responder shield 10 of FIG. 1 as deployed for use. FIG. 3 is a perspective view of the exemplary responder shield 10 of FIG. 1 as deployed for use.

The first responder shield 10 comprises an upper rigid portion 12, a lower flexible portion 14, a quick release connector 16, and a weapon notch 18. The upper portion 12 and the lower flexible portion 12 comprise the shield body which has a threat side and a rear side opposite the threat side. The upper rigid portion 12 has rigidity so that the quick release connector 16 may be secured to the backside of the upper rigid portion 12 near the weapon notch 18 as depicted best in FIG. 1. The disposition of the quick release connector 16 may be used to attach/detach rapidly to/from the quick release connector 16, for example, a Picatinny Rail, on a weapon so that the barrel of the weapon rests within the weapon notch 18. Picatinny Rails are widely used on tactical rifles for attaching accessories such as flashlights, bi-pods, scopes and the like. Of course, other types of quick-release attachments may be used for both rapid attachment and detachment, including Velcro and other known attachments.

When the shield 10 is attached to a weapon and raised to a height where the weapon is held in a firing position while the user is standing, the lower flexible portion 14 will drape below the upper rigid portion 12 in a deployed configuration to protect the user. See FIG. 18 for an exemplary depiction of a weapon 20 attached to the shield 10 while the user is in a standing shooting position. In this way, neither hand is occupied holding the shield 10 in position to the exclusion of holding the weapon 20. The upper rigid portion 12 may have a height of approximately one-third of the overall height of the full body of the shield 10. Although it should be understood that the relative heights of the upper rigid portion 12 and the lower flexible portion 14 may vary or may be custom made for particular users.

The upper rigid portion 12 may be formed unitary with the lower flexible portion 14, or the upper rigid portion may be secured to the lower flexible portion 14 in any suitable manner that does not compromise the ballistic integrity of the shield 10. For example, the lower flexible portion 14 may be formed into a pocket into which a rigid, light-weight ballistic insert is placed and secured. The pocket may then be enclosed about the ballistic insert to form the upper rigid portion 12. In this way the draping shield 10 may transition from the upper rigid portion 12 to the lower flexible portion 14 seamlessly.

FIGS. 2 and 3 also show the draping of the lower flexible portion 14 from the upper rigid portion 12 and the position of attachment for the quick release connector 16. FIGS. 2 and 3 also show the indicia 22 used for identification purposes. Such indicia 22 can be illuminated or reflective and may include textual identifiers such as POLICE (as depicted), FBI, DEA, and the like.

An additional identifier and attention grabber may be lights 24. The lights 24 depicted are red/blue flashing LED lights, but may be any other type of light suitable for use with the shield 10. Such lights 24 may also be directional and of an intensity to serve as flashlights focused in the direction of the aimed weapon 20.

FIG. 4 shows the shield 10 in a folded configuration for storage. Because the lower flexible portion 14 is made of a flexible ballistic material, it drapes as shown in FIGS. 1-3 or it may be folded over onto itself creating folds 25 that enable the shield 10 to occupy a relatively small footprint and low profile for storage in the trunk of a police or SWAT team vehicle, or the like. In this folded configuration, the shield 10 is compact and is easily accessed for use by connecting the weapon 20. In fact, the weapon 20 and shield 10 may be stored while connected so that precious time is not used to attach the weapon 20. If stored while attached, a user can access his/her weapon 20, identification, and shielding in one motion as the weapon is brought to the ready.

A relatively flat storage configuration is achieved if the quick release connector 16 has a hinge assembly 26 that permits the quick release connector to fold against the rear side of the shield 10 into a folded configuration as depicted in FIG. 4. The quick release connector 16 is depicted in its unfolded, aiming configuration in FIGS. 2, 5, 6, 9-11, 15 and 16. As best seen in FIG. 6, the hinge assembly 26 has a shield attachment portion 28, a weapon attachment portion 30, and a hinge pin 32 about which the weapon attachment portion 30 pivots with respect to the shield attachment portion 28 to move the quick release connector 16 between a folded configuration (as shown in FIG. 4) and a unfolded or aiming configuration (as shown in FIG. 6). The hinge assembly 26 is secured to the rear side of the shield 10 body by any suitable method. Although the drawings show that securement to be rivets or bolts that penetrate through the upper rigid portion of the shield 10, it should be understood that any method of securement that does not compromise the ballistic integrity of the shield 10 may be used, including but not limited adhesives, set screws, pins, and the like.

Because the shield attachment portion 28 that is secured to the rear side of the upper rigid portion 12 of the shield 10 body and the hinge pin 32 connects the shield attachment portion 28 to the weapon attachment portion 30 in pivotal engagement, the hinge assembly 26 is moveable between the folded configuration where the weapon attachment portion 30 is substantially parallel to the shield attachment portion 28 and the aiming configuration where the weapon attachment portion 30 is substantially perpendicular to the shield attachment portion 28 by pivoting the weapon attachment portion 30 about the hinge pin 32. Of course, the weapon attachment portion 30 may be locked into the substantially perpendicular aiming configuration, automatically or manually, and may be released by utilizing any one of various mechanisms known to those skilled in the art.

The body of the shield 10 is sufficiently flexible that lower flexible portion 14 is foldable against itself at least once so that the shield 10 body folds into a relatively compact space having a foot print that is at least half of the total area of the shield 10 and has a height profile lower than the height of the upper rigid portion 14 when the shield assembly 10 is in the storage configuration. If at least two folds are used, the foot print will be about a third of the area of the shield 10 body and the height profile may be less than half of the height of the upper rigid portion 14. Of course, the foot print and profile are somewhat dependent on the size of the upper rigid portion 12 compared to the lower flexible portion 14, the larger the upper rigid portion 12, the larger the foot print, and the longer the lower flexible portion 14, the higher the profile.

FIGS. 7-12 are directed to an alternative exemplary embodiment with a transparent, yet ballistic visor 34. FIG. 7 is an elevational perspective view the alternative exemplary responder shield 10 draped downward as if deployed for use and bearing a deployed pivoting visor 34 secured into position by lockable hinges 36. FIG. 8 is an elevational front view of the alternative exemplary responder shield 10 of FIG. 7 with the visor 34 pivoted downward so that the shield 10 may be used without the visor 34 deployed. FIG. 9 is a top view of the alternative exemplary responder shield 10 along the line B-B of FIG. 8. FIG. 10 is an elevational side view of the alternative exemplary responder shield 10 of FIG. 8 showing the visor 34 folded downward. FIG. 11 is an enlarged elevational side view of the alternative exemplary responder shield 10 of FIG. 8 showing area C of FIG. 10 in detail. FIG. 12 is a perspective view of the alternative exemplary responder shield 10 of FIG. 8 folded into a low-profile configuration with the visor 34 tucked between folded layers of the shield 10.

Turning to FIGS. 7 and 8, the alternative responder shield 10 comprises an upper rigid portion 12, a lower flexible portion 14, a quick release connector 16, weapon notch 18, and a visor 34 with a visor weapon notch 38 mounted on lockable hinges 36. As described regarding a previous exemplary embodiment, the upper rigid portion 12 has rigidity so that the quick release connector 16 may be secured to the backside of the upper rigid portion 12 near the weapon notch 18 and the lockable hinges 36 may be secured to both the upper rigid portion 12 and the visor 34. So not to create a seam of vulnerability between the visor 34 and the shield 10, a lower edge 40 of the visor 34 overlaps an upper edge 42 of the shield 10.

The lockable hinges 36 operate to permit the visor 34 to swing freely from its downward disposition as shown in FIG. 8 to its deployed upright position and locks into that position merely by moving the visor 34 to the deployed upright position. This automatic locking of the lockable hinges 36 enables the user to deploy the visor 34 with one quick pivoting motion. Of course, once the threat is subdued or the visor 34 is no longer needed or desired, the lockable hinges 36 may be released manually to allow the visor 34 to pivot back to its downward disposition for storage folding (as will be described later) or for use as a shield 10 without a deployed visor 34, but with additional ballistic shielding in the area about the upper rigid portion 12 of the shield. This additional ballistic shielding does not obscure the indicia 22 or the lights 24, because the visor 34 is transparent. In FIG. 8 the indicia 22 and lights 24 are shown in phantom lines, not because they are obscured from view, but to indicate that they are disposed behind the transparent visor 34 and not actually on the visor. 34

As described above with respect to another exemplary embodiment, the disposition of the quick release connector 16 may be used to attach/detach rapidly to/from the quick release connector 16 on a weapon 20 so that the barrel of the weapon 20 rests within the weapon notch 18. Again, other types of quick-release attachments may be used for both rapid attachment and detachment, including Velcro and other known attachments.

With the exemplary embodiment shown in FIGS. 7-12, the attachment of the weapon 20 to the quick release connector 16 may only occur after the visor 34 is locked into its deployed position, unless the barrel of the weapon 20 extends less than the clearance permitted by the visor weapon notch 38. In that case, the weapon 20 may be attached to the quick release connector 16 before the visor 34 is deployed because the visor 34 will clear the barrel of the weapon 20, because of the visor weapon notch 38, as the visor 34 is pivoted to its locked, deployed position.

When the shield 10, with the visor 34 deployed, is attached to a weapon 20 and raised to a height where the weapon 20 is held in a firing position while the user is standing, the lower flexible portion 14 will drape below the upper rigid portion 12 in a deployed configuration and the visor 34 in its deployed position to protect the user against oncoming bullets or shot. In this way, neither hand is occupied holding the shield 10 or visor 34 in position to the exclusion of holding the weapon 20. The upper rigid portion 12 may have a height of approximately one-third of the overall height of the full body of the shield 10, and the visor 34 may extend the ballistic protection upward additional height (in some instances approximately a height equivalent to the height of the upper rigid portion 12). Although it should be understood that the relative heights of the upper rigid portion 12, the lower flexible portion 14, and the visor may vary or may be custom made for particular users.

FIGS. 9-11 show the quick release connector 16 depicted in its unfolded (aiming) disposition. As best seen in FIG. 11, the hinge assembly 26 has a shield attachment portion 28, a weapon attachment portion 30, and a hinge pin 32 about which the weapon attachment portion 30 pivots with respect to the shield attachment portion 28 to move the quick release connector 16 between a storage configuration (as shown in FIG. 12) and a unfolded or aiming disposition (as shown in FIGS. 10 and 11). It should be noted that the visor 34 does not interfere with the folding or unfolding of the hinge assembly in any way.

FIGS. 9-11 also show that the locking hinges 36 are attached to the top edge 42 of the upper rigid portion 12 and that the lights 24 are sandwiched between the visor 34 and the upper rigid portion 12 when the visor 34 is disposed in its downward disposition.

FIG. 12 shows the shield 10, with the visor 34 in its downward disposition, in a folded configuration for storage. Because the lower flexible portion 14 is made of a flexible ballistic material, it drapes as shown in FIGS. 7, 8, and 10 or it may be folded over onto itself creating folds 25 that enable the shield 10 to occupy a relatively small footprint and low profile for storage in the trunk of a police or SWAT team vehicle, or the like. A relatively flat storage configuration is achieved if the quick release connector 16 has a hinge assembly 26 that permits the quick release connector 16 to fold against the backside of the shield 10 as depicted in FIG. 12. In this folded configuration, the shield 10 is compact and is easily accessed for use by connecting the weapon 20. In fact, the weapon 20 and shield 10 may be stored while connected so that precious time is not used to attach the weapon 20. If stored while attached, a user can access his/her weapon 20, identification, and shielding in one motion.

A relatively flat storage configuration is achieved if the quick release connector 16 has a hinge assembly 26 that permits the quick release connector to fold against the backside of the shield 10. As shown in FIG. 12 the visor 34 tucks into the void between the upper rigid portion 12 and a folded over portion of the lower flexible portion 14. In this manner, the addition of the visor 34 to the responder shield 10 does not add significantly to the small footprint and low profile (of a non-visored shield 10) for storage in the trunk of a police or SWAT vehicle, or the like.

In the folded configuration shown in FIG. 12, the weapon 20 may be attached for single motion deployment, if the barrel or the weapon 20 has a length that will clear the visor 34 when the visor 34 is pivotally deployed and locked into position. Otherwise, the weapon 20 is attached after the visor 34 is pivotally moved about its locking hinges 36 and locked into position. In either event, the shield 10, visor 34, and weapon 20, along with the user's identification are deployed rapidly.

Yet another exemplary embodiment of the responder shield 10 with a visor 34 is depicted in FIGS. 13-17. FIG. 13 is an elevational perspective view of another exemplary embodiment of a responder shield 10 draped downward as if deployed for use and bearing a visor 34 secured into position by insertable posts 44 within receiving channels 46 (not visible in FIG. 13). FIG. 13 also shows that the lower edge 40 of the visor 34, when deployed, is disposed below and behind the upper edge 42 of the upper rigid portion 12 if the shield 10 so that a vulnerable seam is not exposed to oncoming bullets or shot. FIG. 14 is an exploded perspective view of the exemplary responder shield 10 of FIG. 13 folded into a low-profile configuration with the visor 34 detached, but positioned for insertable posts 44 to enter into receiving channels 46. FIG. 15 is an elevational front view of the alternative exemplary responder shield 10 of FIG. 13 with the visor 34 removed for clarity and so not to obscure the details shown in FIGS. 16 and 17. FIG. 16 is a top view of the alternative exemplary responder shield 10 along the line D-D of FIG. 15. FIG. 17 is an enlarged elevational side view of the alternative exemplary responder shield 10 along line E-E of FIG. 15;

With the exemplary embodiment shown in FIGS. 13-17, the attachment of the weapon 20 to the quick release connector 16 may only occur after the visor 34 is secured into its deployed position by sliding the insertable posts 44 into the receiving channels 46, unless the barrel of the weapon 20 extends less than the clearance permitted by the visor weapon notch 38. In that case, the weapon 20 may be attached to the quick release connector 16 before the visor 34 is deployed because the visor 34 will clear the barrel of the weapon 20, because of the visor weapon notch 38, as the weapon 20 is raised to a ready position.

When the shield 10, with the visor 34 deployed, is attached to a weapon 20 and raised to a height where the weapon 20 is held in a firing position while the user is standing, the lower flexible portion 14 will drape below the upper rigid portion 12 in a deployed configuration and the visor 34 in its deployed position to protect the user against oncoming bullets or shot. In this way, neither hand is occupied holding the shield 10 or visor 34 in position to the exclusion of holding the weapon 20. The upper rigid portion 12 may have a height of approximately one-third of the overall height of the full body of the shield 10, and the visor 34 may extend the ballistic protection upward additional height (in some instances approximately a height equivalent to the height of the upper rigid portion 12). Although it should be understood that the relative heights of the upper rigid portion 12, the lower flexible portion 14, and the visor may vary or may be custom made for particular users.

FIG. 14 shows the shield 10, with the visor 34 ready for slidable insertion, in a folded configuration for storage. Because the lower flexible portion 14 is made of a flexible ballistic material, it drapes as shown in FIGS. 13 and 15 or it may be folded over onto itself creating folds 25 that enable the shield 10 to occupy a relatively small footprint and low profile for storage in the trunk of a police or SWAT team vehicle, or the like. A relatively flat storage configuration is achieved if the quick release connector 16 has a hinge assembly 26 that permits the quick release connector 16 to fold against the backside of the shield 10 as depicted in FIG. 14. In this folded configuration, the shield 10 is compact and is easily accessed for use by connecting the weapon 20. In fact, the weapon 20 and shield 10 may be stored while connected so that precious time is not used to attach the weapon 20. If stored while attached, a user can access his/her weapon 20, identification, and shielding in one motion.

A relatively flat storage configuration is achieved if the quick release connector 16 has a hinge assembly 26 that permits the quick release connector to fold against the backside of the shield 10. For storage purposes, the visor 34 may be tucked loosely into the void between the upper rigid portion 12 and a folded over portion of the lower flexible portion 14 or positioned nearby. In this manner, the addition of the visor 34 to the responder shield 10 does not add significantly to the small footprint and low profile (of a non-visored shield 10) for storage in the trunk of a police or SWAT vehicle, or the like.

In the folded configuration shown in FIG. 14, the weapon 20 may be attached for single motion deployment, if the barrel or the weapon 20 has a length that will clear the visor 34 when the visor 34 is secured by having the insertable posts 44 slidably engaging the receiving channels 46 either during storage or just before grasping the weapon 20 for use. Otherwise, the weapon 20 is attached after the visor 34 is secured by sliding the insertable posts 44 into the receiving channels 46. In either event, the shield 10, visor 34, and weapon 20, along with the user's identification are deployed rapidly.

FIGS. 16 and 17 show the quick release connector 16 depicted in its unfolded (aiming) disposition. Although the receiving channel 46 obscures the best view of the hinge assembly 26 in FIG. 17, the hinge assembly 26 has a shield attachment portion 28, a weapon attachment portion 30, and a hinge pin 32 (obscured from view) about which the weapon attachment portion 30 pivots with respect to the shield attachment portion 28 to move the quick release connector 16 between a storage configuration (as shown in FIG. 14) and a unfolded or aiming disposition (as shown in FIGS. 16 and 17). It should be noted that the visor 34 does not interfere with the folding or unfolding of the hinge assembly in any way.

FIGS. 16 and 17 also show that the receiving channels 46 attached to the rear surface 48 of the upper rigid portion 12 and that the lights 24 are not encumbered by the receiving channels 46 or the visor 34.

FIGS. 18-20 depict visor-less responder shield as deployed for various shooting positions. FIG. 18 is a perspective view of a user in a standing position for shooting with an exemplary responder shield 10 secured to and draped from the user's weapon 20. Although, FIG. 18 shows a relatively short draping on the shield 10, it should be understood that the length of the draping lower flexible portion 14 of the shield may be manufactured in various widths and lengths or may be custom made to a specified width and/or length to best fit the height and the weight requirement of the user.

FIG. 19 is a perspective view of a user in a kneeling position shooting shooting with an exemplary responder shield 10 secured to and draped from the user's weapon 20, where the lower flexible portion 14 of the shield 10 touches the ground. In this shooting position, depending on how the user advances into the shooting position, the lower flexible portion 14 may curl forward or backward (a backward curl is depicted in FIG. 19). This curl of the lower flexible portion 14 of the shield 10 may provide effective protection against skip rounds being fired at the user.

FIG. 20 is a perspective view of a user in a prone shooting with an exemplary responder shield 10 secured to and acting as a gun rest for the user's weapon 20. In this shooting position, depending on how the user advances into the shooting position, the lower flexible portion 14 may curl forward or backward or if the user has time the forward or backward curl may be staged by the user to position the ballistic material of the lower flexible portion 14 of the shield 10 as the user desires. Again, this curl of the lower flexible portion 14 of the shield 10 may provide effective protection against skip rounds being fired at the user while in the prone shooting position.

Additionally, of course, the upper rigid portion 12 may be used as a gun rest for the user in other than the prone position while sitting, kneeling or standing, for example, so long as there is some type of support structure, such as a rock, furniture, or the like, that the lower edge of the upper rigid portion 12 can rest upon. For the purposes of this application, the term "supporting surface" shall mean any supporting structure, natural (e.g., the ground, a rock, a ledge, etc.) or man-made (e.g., furniture, car hood, etc.) upon which the upper rigid portion 12 of the shield 10 may rest upon to assist the user as a gun rest.

The solution to the issues identified above and the primary purpose of the exemplary responder shield 10 disclosed is to provide a light-weight shield 10 removably attachable to a police rifle or other weapon 20 that can protect law enforcement personnel against potential threats while responding to an active shooter. The exemplary shield 10 is designed primarily to provide protection against deadly projectiles using a combination of rigid and flexible ballistic material that are relatively lightweight and removably attached to the police officer's weapon 20 so it takes no or very little additional time to deploy.

Numerous unique problems exist for law enforcement when confronting an active shooter situation. For example, in an active shooter situation, the longer it takes for the police to confront the perpetrator the likelihood that more people shot and/or killed increases. Because the exemplary shield 10 is a lightweight ballistic shield 10 that may already be attached to a police rifle or other weapon 20, no set-up time is required at the time of the situation. The exemplary shield's 10 unique design enables its users to arrive at a conflict, grab their weapon 20, and go to meet the threat, thus obtaining ballistic protection, police identification and fire power in one simple action.

Typically, ballistic material is very heavy. A conventional hand gun shield weighs 30+ pounds. Such weight is detrimental to a rapid and sustained response because the user can tire rapidly while running and/or aiming his/her weapon 20, thus affecting shooting accuracy and decision making. The present exemplary shield 10 is a lightweight ballistic shield 10 weighing less than 5 pounds, virtually eliminating concerns regarding detrimental user fatigue.

If law enforcement personnel carry conventional shields, it is difficult, and in some cases, impossible to manipulate their weapons 20. The present exemplary shield 10 may be attached to the user's weapon 20 and drapes to protect the user, and frees both of the user's hands to hold his/her weapon 20.

Often confrontation with an active shooter occurs at night or in an unlit environment. With presently known shields, not only does the user hold the shield and his/her weapon 20, but also must train a flashlight on the surroundings or the active shooter. The present exemplary shield 10 may have LED lights 24 (the flashing red/blue lights used for identification may be augmented by additional white lights 24 or substituted for white lights 24) mounted to the front of the shield 10 to illuminate the threat area, without compromising the user because his/her hands are free from holding a flashlight.

Multiple agencies, even plain clothes police may respond to an active shooter situation where there is no time to coordinate or identify the "good guys". In such instances, grave danger arises subjecting responders to possible misidentification and/or friendly fire. The present exemplary shield 10 virtually eliminates that danger because the shield 10 has "POLICE" or some other identifier indicia in large letters and optional red and blue LED flashing lights mounted to the front of the shield 10 to provide instant identification and to draw the attention of the active shooter away from the victims.

Additionally, storage space is a premium in a police vehicle. Conventional shields are rigid and usually curved making them very difficult to store in the limited space of a police vehicle. However, the present exemplary shield 10 is partially flexible so it can fold into thirds requiring very little storage space.

Smaller agencies may not have the budget for their officers to have multiple weapons 20 and in an active shooter situation there is no time for elaborate set-up times. The present invention utilizes a quick connect system that permits the shield 10 to be attached to any police rifle or other weapon 20 in a matter of seconds. It has also been contemplated that Velcro could be utilized as a universal shield attachment method. It should be understood that any suitable quick attachment/release may be used to secure the shield 10 rapidly to a weapon 20 and releasably.

Some environments offer no cover for a responding officer to stand behind. The natural tendency is to drop to the ground, however, this often leaves the officer vulnerable, particularly to skip rounds (rounds that are purposely shot into the ground to skip into the prone officer), or from an elevated shooter.

The present exemplary shield has been developed with the top third of the shield being rigid approximating the height of a bi-pod gun rest. This unique feature offers protection for a prone officer and forms a gun rest.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under Section 112, 6th paragraph is not intended. Additionally, it is not intended that the scope of patent protection afforded the present invention be defined by reading into any claim a limitation found herein that does not explicitly appear in the claim itself.

While specific embodiments and applications of the present invention have been illustrated and described, it is to be understood that the invention is not limited to the precise configuration and components disclosed herein. Various modifications, changes, and variations which will be apparent to those skilled in the art may be made in the arrangement, operation, and details of the methods and systems of the present invention disclosed herein without departing from the spirit and scope of the invention.

Those skilled in the art will appreciate that the present embodiments may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

The invention claimed is:

1. A ballistic shield assembly to provide ballistic protection to a user, the shield assembly for detachable attachment to a weapon and having a deployed configuration while attached and draping from the weapon, a gun rest configuration while resting upon a support surface, and a storage configuration while folded into a relatively small foot print and low profile, the shield assembly comprising:

a shield body having an upper rigid portion, a lower flexible portion, a threat side, and a rear side;

a quick release connector secured to the rear side of the shield body for detachable connection of the weapon, wherein the lower flexible portion drapes downward from the upper rigid portion in the deployed configuration when the weapon is connected to the shield assembly and the weapon is moved to the ready; and wherein the quick release connector comprises a hinge assembly having a folded configuration and an aiming configuration, the hinge assembly comprising a shield attachment portion that is secured to the rear side of the upper rigid portion of the shield body, a weapon attachment portion for detachably attaching the weapon thereto, and a hinge pin connecting the shield attachment portion to the weapon attachment portion in pivotal engagement, whereby the hinge assembly is moveable between the folded configuration where the weapon attachment portion is substantially parallel to the shield attachment portion and the aiming configuration where the weapon attachment portion is substantially perpendicular to the shield attachment portion by pivoting the weapon attachment portion about the hinge pin.

2. The shield assembly of claim 1 wherein shield assembly is in the gun rest configuration when the weapon is detachably connected to the quick connector and the upper rigid portion of the shield body is positioned to rest on the support surface, thereby enabling the user to use the shield assembly as a gun rest.

3. The shield assembly of claim 1 wherein the lower flexible portion of the shield body is sufficiently flexible that lower flexible portion is foldable at least once so that the shield body folds into a relatively compact space having a foot print that is at least half of the area of the shield body and a profile lower than the height of the upper rigid portion when the shield assembly is in the storage configuration.

4. The shield assembly of claim 1 further comprising indicia on the threat side of the shield body that provides identification of the user of the shield assembly.

5. The shield assembly of claim 4, wherein the indicia comprises at least one of lettering and lights.

6. The shield assembly of claim 1 further comprising lights disposed on the threat side of the shield body, at least one of the lights provides illumination of the vicinity forward of the shield assembly.

7. The shield assembly of claim 1 wherein at least a portion of the shield body is made of a lightweight flexible ballistic material comprising Dyneema.

8. A ballistic shield assembly for detachable attachment to a weapon, the shield comprising:

a shield body having an upper rigid portion with an upper edge, a lower flexible portion, a threat side, and a rear side, the lower flexible portion;

a visor for attachment to and deployment extending above the upper rigid portion of the shield body, the visor being transparent and made of a ballistic material and having a lower edge;

a quick release connector secured to the rear side of the shield body for detachable connection of the weapon to the shield assembly, the lower flexible portion drapes downward from the upper rigid portion when the weapon is connected to the shield assembly and the weapon is moved to the ready; and wherein the quick release connector comprises a hinge assembly having a folded configuration and an aiming configuration, the hinge assembly comprising a shield attachment portion that is secured to the rear side of the upper rigid portion of the shield body, a weapon attachment portion for detachably attaching the weapon thereto, and a hinge pin connecting the shield attachment portion to the weapon attachment portion in pivotal engagement, whereby the hinge assembly is moveable between the folded configuration where the weapon attachment portion is substantially parallel to the shield attachment portion and the aiming configuration where the weapon attachment portion is substantially perpendicular to the shield attachment portion by pivoting the weapon attachment portion about the hinge pin.

9. The shield assembly of claim 8, wherein the lower edge of the visor is disposed below and rearward of the upper edge of the upper rigid portion of the shield body when the visor is attached and deployed extending above the shield body, whereby at least a portion of the visor overlaps at least a portion of the upper rigid portion of the shield body.

10. The shield assembly of claim 9 further comprising lockable hinges that connecting the shield body to the visor in pivoting engagement, the visor being pivotable between a downward disposition forward of the threat side of the upper rigid portion of the shield and a deployed disposition extending above the shield body.

11. The shield assembly of claim 10 further comprising indicia on the threat side of the shield body that provides identification of the user of the shield assembly, the indicia being visible through the visor when the visor is disposed in the downward disposition.

12. The shield assembly of claim 11, wherein the indicia comprises at least one of lettering and lights.

13. The shield assembly of claim 9 further comprising insertable posts attached to the visor and receiving channels attached to the rear side of the upper rigid portion of the shield body, the insertable posts being removably insertable into the receiving channels in sliding engagement.

14. The shield assembly of claim 8 wherein at least a portion of the shield body is made of a lightweight flexible ballistic material comprising Dyneema.

15. A method for protecting a user with a weapon from projectiles from an assailant, the method comprising the step of:

providing a shield assembly with an upper rigid portion, a lower flexible portion, and a quick release connector for releasably securing the weapon to the shield assembly;

securing the weapon to the quick release connector;

deploying the shield assembly so that the lower flexible portion drapes downward from the weapon when the user grasps the weapon and moves the weapon to the ready; and further comprising the step of folding the shield assembly into a storage configuration and wherein the quick release connector comprises a hinge assembly having a folded configuration and an aiming configuration, the securing of the weapon to the quick release connector while the shield assembly is in the storage configuration and the hinge assembly is in the folded configuration.

16. The method of claim 15 further comprising the step of folding the shield assembly into a storage configuration and wherein the quick release connector comprises a hinge assembly having a folded configuration and an aiming configuration, the securing of the weapon to the quick release connector while the shield assembly is in the storage configuration and the hinge assembly is in the folded configuration.

17. The method of claim 15 wherein the shield assembly moves from the storage configuration to the deployed configuration with the lower flexible portion draping downward from the weapon as the user grasps the weapon moves the weapon to the ready.

18. The method of claim 15 further comprising the step of deploying a visor to overlap with and extend above the upper rigid portion of the shield assembly.

19. The method of claim 15 wherein the shield assembly further comprising indicia on a threat side of the shield assembly, the indicia body providing identification of the user of the shield assembly.

* * * * *